US006551099B1

(12) United States Patent
Kapinski

(10) Patent No.: US 6,551,099 B1
(45) Date of Patent: Apr. 22, 2003

(54) MULTIPLE LAYERED AND SCENTED CANDLE

(76) Inventor: Sophia Kapinski, 1024 Chelton Ave., Pittsburgh, PA (US) 15226

( * ) Notice: Subject to any disclaimer, the term of this patent is extended or adjusted under 35 U.S.C. 154(b) by 4 days.

(21) Appl. No.: 09/966,378

(22) Filed: Sep. 28, 2001

(51) Int. Cl.[7] ..... F23D 3/16
(52) U.S. Cl. ..... 431/288; 431/126
(58) Field of Search ..... 431/126, 288, 431/289, 292, 293, 295; D26/6; 362/161, 159

(56) References Cited

U.S. PATENT DOCUMENTS

| | | | | |
|---|---|---|---|---|
| 3,283,546 A | | 11/1966 | Matsui | |
| D209,487 S | | 12/1967 | Crumrine | |
| 3,388,960 A | * | 6/1968 | Cangialosi | 431/288 |
| 3,706,523 A | | 12/1972 | Kumm | |
| 4,077,110 A | | 3/1978 | Reiher | |
| 4,826,428 A | | 5/1989 | Lam | |
| 5,597,300 A | | 1/1997 | Wohl et al. | |
| 6,171,103 B1 | * | 1/2001 | Orlandi | 431/295 |

FOREIGN PATENT DOCUMENTS

| | | | | |
|---|---|---|---|---|
| EP | 0 018 839 | * | 11/1980 | 431/288 |
| JP | 57-135899 | * | 8/1982 | 431/126 |

* cited by examiner

*Primary Examiner*—James C. Yeung

(57) ABSTRACT

A multiple layered and scented candle for providing several fragrances and colors from just one candle. The multiple layered and scented candle includes a layered wax material including a plurality of wax segments; and also includes a wick being disposed in the layered wax material and extending a length thereof and having a top end portion which extends outwardly from the layered wax material.

4 Claims, 2 Drawing Sheets

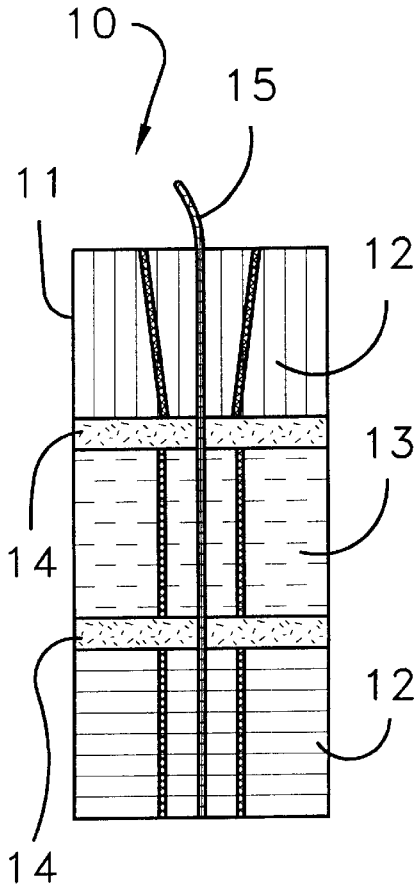
FIG. 1
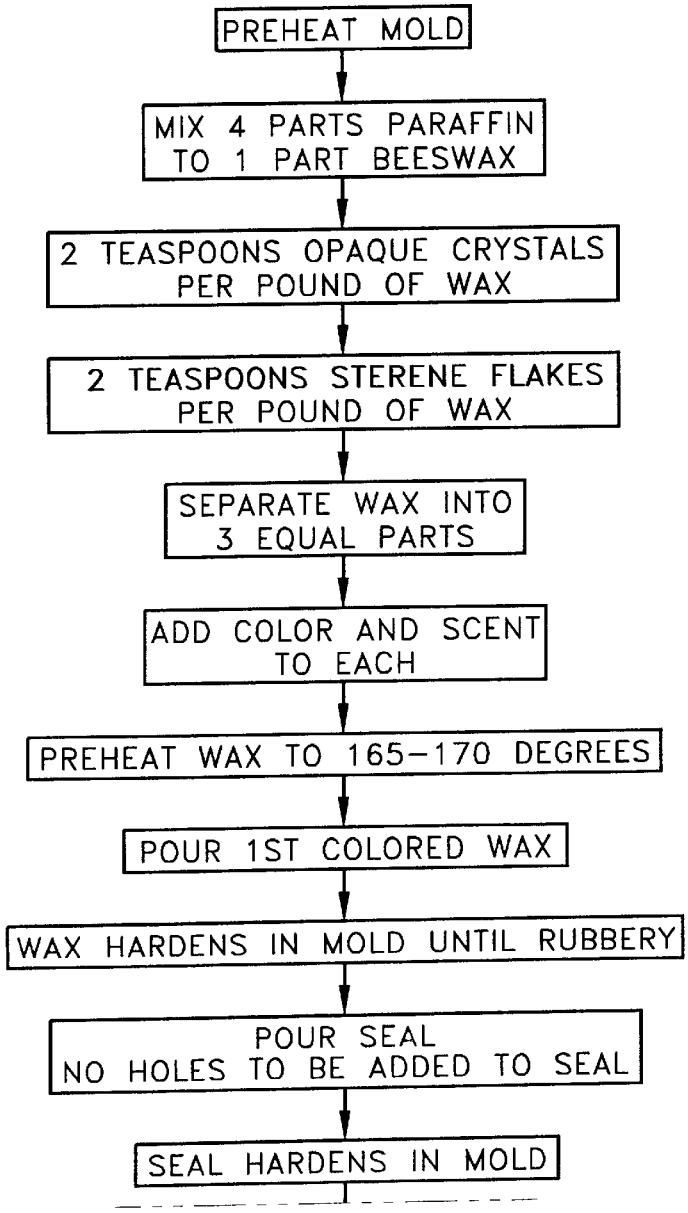
| |
|---|
| FIG. 2A |
| FIG. 2B |
FIG. 2
FIG. 2A

MULTIPLE LAYERED AND SCENTED CANDLE

BACKGROUND OF THE INVENTION

1. Field of the Invention

The present invention relates to layered and scented candles and more particularly pertains to a new multiple layered and scented candle for providing several fragrances and colors from just one candle.

2. Description of the Prior Art

The use of layered and scented candles is known in the prior art. More specifically, layered and scented candles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,077,110; U.S. Pat. No. 5,597,300; U.S. Pat. No. 3,706,523; U.S. Pat. No. Des. 209,487; U.S. Pat. No. 4,826,428; and U.S. Pat. No. 3,283,546.

While these devices fulfill their respective, particular objectives and requirements, the aforementioned patents do not disclose a new multiple layered and scented candle. The inventive device includes a layered wax material including a plurality of wax segments; and also includes a wick being disposed in the layered wax material and extending a length thereof and having a top end portion which extends outwardly from the layered wax material.

In these respects, the multiple layered and scented candle according to the present invention substantially departs from the conventional concepts and designs of the prior art, and in so doing provides an apparatus primarily developed for the purpose of providing several fragrances and colors from just one candle.

SUMMARY OF THE INVENTION

In view of the foregoing disadvantages inherent in the known types of layered and scented candles now present in the prior art, the present invention provides a new multiple layered and scented candle construction wherein the same can be utilized for providing several fragrances and colors from just one candle.

The general purpose of the present invention, which will be described subsequently in greater detail, is to provide a new multiple layered and scented candle and method which has many of the advantages of the layered and scented candles mentioned heretofore and many novel features that result in a new multiple layered and scented candle which is not anticipated, rendered obvious, suggested, or even implied by any of the prior art layered and scented candles, either alone or in any combination thereof.

To attain this, the present invention generally comprises a layered wax material including a plurality of wax segments; and also includes a wick being disposed in the layered wax material and extending a length thereof and having a top end portion which extends outwardly from the layered wax material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple layered and scented candle which has many of the advantages of the layered and scented candles mentioned heretofore and many novel features that result in a new multiple layered and scented candle which is not anticipated, rendered obvious, suggested, or even implied by any of the prior art layered and scented candles, either alone or in any combination thereof.

It is another object of the present invention to provide a new multiple layered and scented candle which may be easily and efficiently manufactured and marketed.

It is a further object of the present invention to provide a new multiple layered and scented candle which is of a durable and reliable construction.

An even further object of the present invention is to provide a new multiple layered and scented candle which is susceptible of a low cost of manufacture with regard to both materials and labor, and which accordingly is then susceptible of low prices of sale to the consuming public, thereby making such multiple layered and scented candle economically available to the buying public.

Still yet another object of the present invention is to provide a new multiple layered and scented candle which provides in the apparatuses and methods of the prior art some of the advantages thereof, while simultaneously overcoming some of the disadvantages normally associated therewith.

Still another object of the present invention is to provide a new multiple layered and scented candle for providing several fragrances and colors from just one candle.

Yet another object of the present invention is to provide a new multiple layered and scented candle which includes a layered wax material including a plurality of wax segments; and also includes a wick being disposed in the layered wax material and extending a length thereof and having a top end portion which extends outwardly from the layered wax material.

Still yet another object of the present invention is to provide a new multiple layered and scented candle that is easy and convenient to use.

Even still another object of the present invention is to provide a new multiple layered and scented candle that adds eye-appealing decor to the room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a cross-sectional view of a new multiple layered and scented candle according to the present invention.

FIG. 2 is a flow chart of the method of making the present invention.

FIG. 2A is a detailed flow chart of the method making the present invention.

DESCRIPTION OF THE PREFERRED EMBODIMENT

Figure 2B:
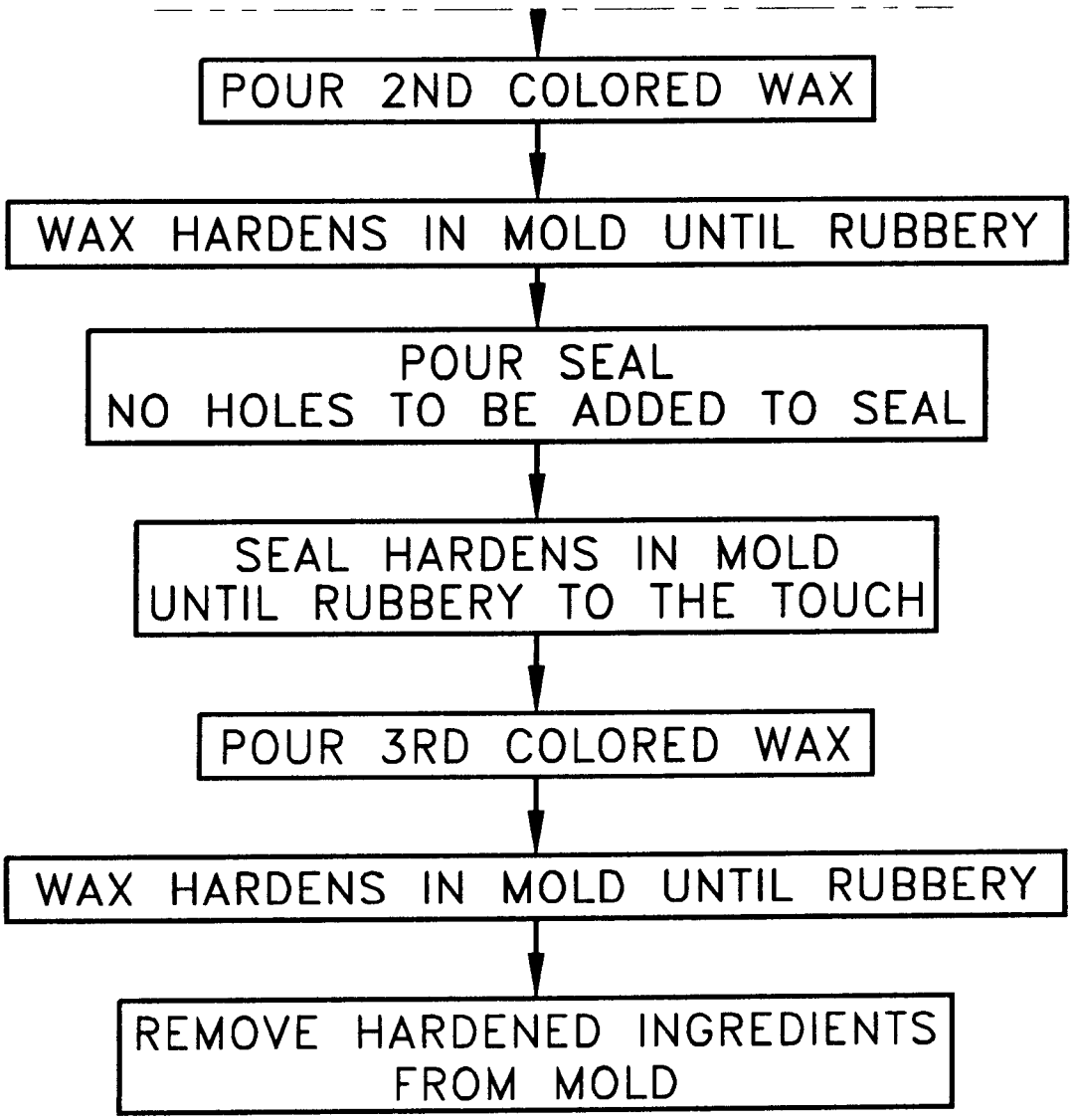
FIG. 2B is a continuous detailed flow chart of the method of making the present invention.

With reference now to the drawings, and in particular to FIGS. 1 through 2B thereof, a new multiple layered and scented candle embodying the principles and concepts of the present invention and generally designated by the reference numeral 10 will be described.

As best illustrated in FIGS. 1 through 2B, the multiple layered and scented candle 10 generally comprises a layered wax material 11 including a plurality of wax segments 12–14. The wax segments 12–14 include scented wax segments 12, colored wax segments 13, and seal wax segments 14 separating the scented wax segments 12 from one another and also separating the colored wax segments 13 from one another and from the scented wax segments 12. The wax segments 12–14 are arranged to form the layered wax material 11. Each of the wax segments 12–14 is made of paraffin, beeswax opaque crystals, and styrene flakes. Also, a plurality of the wax segments 12–14 also includes color pigments and odor-emitting substances. Each of the seal wax segments 14 has a thickness of approximately ½ inch. A wick 15 is conventionally disposed in the layered wax material 11 and extends a length thereof and has a top end portion which extends outwardly from the layered wax material 11.

To make the layered and scented candle 10, a mold having cavities is provided along with paraffin, beeswax, opaque crystals, styrene flakes, color pigments, and odor-emitting substances. Approximately 4 parts of the paraffin is mixed with approximately 1 part of the beeswax to form wax. 2 teaspoons of the opaque crystals and 2 teaspoons of the styrene flakes are added per pound of the wax. The wax mixture is then separated into parts. The color pigments and the odor-emitting substances are added to a plurality of the parts of the wax mixture which is heated to approximately 164–170 degrees Fahrenheit and which is poured into a plurality of the cavities in the mold for hardening to form wax segments 12–14 upon which the wax segments 12–14 are removed to form a layered wax material 11. The wick 15 is inserted in the layered wax material 11 to form the multiple layered and scented candle 10. Parts of the wax mixture which includes the color pigments and the odor-emitting substances are first poured into a plurality of the cavities to form colored and scented wax segments 12,13. Then, parts of the wax mixture without the colored and scented wax segments are poured into a plurality of the cavities of the mold for hardening to form seal wax segments 14. When torming the layered wax material 11, the colored and scented wax segments 12,13 are separated from one another with the seal wax segments 14.

In use, the layered and scented candle 10 gives off an array of colors and also various fragrances which are not merged into one another as the wick 15 burns through the layered wax material 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple layered and scented candle comprising:

a layered wax material including a plurality of wax segments; and a wick being disposed in said layered wax material and extending a length thereof and having a top end portion which extends outwardly from said layered wax material; and wherein said wax segments include scented wax segments, colored wax segments, and seal wax segments separating said scented wax segments from one another and also separating said colored wax segments from one another and from said scented wax segments, said wax segments being arranged to form said layered wax material.

2. A multiple layered and scented candle as described in claim 1, wherein each of said wax segments is made of paraffin, beeswax, opaque crystals, and styrene flakes.

3. A multiple layered and scented candle as described in claim 2, wherein a plurality of said wax segments also include color pigments and odor-emitting substances.

4. A multiple layered and scented candle comprising:

a layered wax material including a plurality of wax segments, said wax segments including scented wax segments, colored wax segments, and seal wax segments separating said scented wax segments from one another and also separating said colored wax segments from one another and from said scented wax segments, said wax segments being arranged to form said layered wax material, each of said wax segments being made of paraffin, beeswax, opaque crystals, and styrene flakes, a plurality of said wax segments also including color pigments and odor-emitting substances, each of said seal wax segments having a thickness of approximately ½ inch; and a wick being disposed in said layered wax material and extending a length thereof and having a top end portion which extends outwardly from said layered wax material.

* * * * *